US011634295B2

(12) United States Patent
Vegliante

(10) Patent No.: US 11,634,295 B2
(45) Date of Patent: Apr. 25, 2023

(54) ROLL-DISPENSED STOCK CONTAINER

(71) Applicant: Cutting Edge Packaging Solutions, LLC, Sarasota, FL (US)

(72) Inventor: Paul Vegliante, Sarasota, FL (US)

(73) Assignee: Cutting Edge Packaging Solutions, LLC, Sarasota, FL (US)

( * ) Notice: Subject to any disclaimer, the term of this patent is extended or adjusted under 35 U.S.C. 154(b) by 0 days.

(21) Appl. No.: 17/152,590

(22) Filed: Jan. 19, 2021

(65) Prior Publication Data

US 2021/0139266 A1 May 13, 2021

Related U.S. Application Data

(63) Continuation of application No. 15/832,953, filed on Dec. 6, 2017, now Pat. No. 10,894,688.

(51) Int. Cl.

| | |
|---|---|
| ***B65H 35/00*** | (2006.01) |
| ***B65D 43/16*** | (2006.01) |
| ***B26D 1/04*** | (2006.01) |
| ***B26D 1/06*** | (2006.01) |
| ***B26D 7/14*** | (2006.01) |

(52) U.S. Cl.

CPC ..... *B65H 35/0086* (2013.01); *B26D 1/045* (2013.01); *B26D 1/065* (2013.01); *B26D 7/14* (2013.01); *B65D 43/16* (2013.01); *Y10T 83/7507* (2015.04); *Y10T 83/8769* (2015.04); *Y10T 83/8822* (2015.04); *Y10T 83/896* (2015.04)

(58) Field of Classification Search

CPC ..... Y10T 83/8822; B65H 35/0086; B65H 2701/1752; B65H 2301/5154; B65H 43/16; B26D 1/045; B26D 7/015; B26D 1/065; B26D 7/14; B65D 43/16

USPC ..... 83/614

See application file for complete search history.

(56) References Cited

U.S. PATENT DOCUMENTS

| | | | | |
|---|---|---|---|---|
| 1,827,029 | A | 10/1931 | Marcalus | |
| 2,115,891 | A | 5/1938 | Fishier | |
| 2,118,380 | A | 5/1938 | Gresenz | |
| 2,713,939 | A | 7/1955 | Lear | |
| 3,071,034 | A | 1/1963 | Castelli | |
| 3,079,827 | A * | 3/1963 | Castelli | B65H 35/0006 83/614 |

(Continued)

FOREIGN PATENT DOCUMENTS

| | | | |
|---|---|---|---|
| CA | 2156643 | A1 | 2/1997 |
| EP | 1475027 | A2 | 11/2004 |

(Continued)

OTHER PUBLICATIONS

Office Action dated Oct. 8, 2021, issued in connection with U.S. Appl. No. 17/218,055 (7 pages).

(Continued)

*Primary Examiner* — Laura M Lee

(74) *Attorney, Agent, or Firm* — McCarter & English, LLP

(57) ABSTRACT

A roll-dispensed stock container is provided with fixation strips attached to the body of the container and a cutter assembly attached to a lid of the container. Roll-dispensed stock is secured by the fixation strips when the lid of the container is in a closed configuration and the cutter assembly is configured to separate a sheet of the roll-dispensed stock of a desired length.

18 Claims, 16 Drawing Sheets

(56) References Cited

U.S. PATENT DOCUMENTS

| | | | | |
|---|---|---|---|---|
| 3,153,853 | A | 10/1964 | Lipton | |
| 3,165,283 | A | 1/1965 | Kaiser et al. | |
| 3,301,117 | A | 1/1967 | Spaulding | |
| 3,549,066 | A | 12/1970 | Wankow | |
| 3,561,312 | A * | 2/1971 | Jones | B65H 35/0086 83/485 |
| 4,156,382 | A * | 5/1979 | Baker | B29C 66/861 156/510 |
| 4,197,774 | A | 4/1980 | Singh et al. | |
| D255,779 | S | 7/1980 | Clatterbuck | |
| 4,210,043 | A | 7/1980 | Urion et al. | |
| 4,340,162 | A | 7/1982 | Heiman et al. | |
| 4,346,829 | A | 8/1982 | Myers | |
| 4,417,495 | A * | 11/1983 | Gordon | B26D 7/14 225/43 |
| 4,586,639 | A | 5/1986 | Ruff et al. | |
| D293,211 | S | 12/1987 | DePaul et al. | |
| 4,960,022 | A | 10/1990 | Chuang | |
| 5,292,046 | A | 3/1994 | Kaiser et al. | |
| D347,345 | S | 5/1994 | Kaiser et al. | |
| 5,322,001 | A | 6/1994 | Boda | |
| 5,440,961 | A | 8/1995 | Lucas, Jr. et al. | |
| 5,772,094 | A | 6/1998 | Kaiser et al. | |
| D396,978 | S | 8/1998 | Kaiser et al. | |
| 5,802,942 | A | 9/1998 | Cornell et al. | |
| 5,941,476 | A | 8/1999 | Copass | |
| 6,223,639 | B1 * | 5/2001 | Chen | B26D 1/045 225/93 |
| 6,269,970 | B1 | 8/2001 | Huang et al. | |
| D447,685 | S | 9/2001 | Chagnon et al. | |
| D504,314 | S | 4/2005 | Kim | |
| 6,931,974 | B2 | 8/2005 | Tseng | |
| D540,187 | S | 4/2007 | Duffy | |
| 7,299,731 | B2 | 11/2007 | Schulz | |
| 7,406,904 | B2 | 8/2008 | Antal et al. | |
| 7,603,937 | B2 | 10/2009 | Pavlik et al. | |
| 7,845,261 | B2 | 12/2010 | Chiang | |
| 7,918,151 | B2 | 4/2011 | Vegliante et al. | |
| 7,921,756 | B2 | 4/2011 | Vegliante et al. | |
| D643,747 | S | 8/2011 | Rye et al. | |
| 7,987,758 | B2 | 8/2011 | Chabansky | |
| D700,837 | S | 3/2014 | Antal, Sr. | |
| 8,684,228 | B2 | 4/2014 | Parker | |
| D727,170 | S | 4/2015 | Lokey et al. | |
| D728,258 | S | 5/2015 | Cohen | |
| D778,149 | S | 2/2017 | Frick | |
| 9,604,382 | B2 | 3/2017 | Vegliante et al. | |
| D787,324 | S | 5/2017 | Sotka | |
| D787,931 | S | 5/2017 | Beck et al. | |
| D815,522 | S | 4/2018 | Vegliante | |
| D873,659 | S | 1/2020 | Vegliante | |
| 10,836,558 | B2 | 11/2020 | Vegliante | |
| 10,894,688 | B2 | 1/2021 | Vegliante | |
| 10,959,580 | B2 | 3/2021 | Vegliante | |
| 11,407,580 | B2 | 8/2022 | Vegliante | |
| 2002/0023526 | A1 | 2/2002 | Vegliante et al. | |
| 2002/0056785 | A1 | 5/2002 | Newman et al. | |
| 2002/0096031 | A1 | 7/2002 | Yang | |
| 2002/0117038 | A1 | 8/2002 | Vegliante et al. | |
| 2003/0127352 | A1 | 7/2003 | Buschkiel et al. | |
| 2003/0140760 | A1 | 7/2003 | Bory | |
| 2004/0040429 | A1 | 3/2004 | Nichols et al. | |
| 2004/0237746 | A1 | 12/2004 | Schultz et al. | |
| 2005/0005755 | A1 | 1/2005 | Turvey et al. | |
| 2005/0034585 | A1 * | 2/2005 | Antal | B26D 1/045 83/649 |
| 2005/0035133 | A1 | 2/2005 | Gerulski et al. | |
| 2005/0166738 | A1 | 8/2005 | Hsu | |
| 2005/0223863 | A1 | 10/2005 | Volfson et al. | |
| 2006/0156885 | A1 | 7/2006 | Wu | |
| 2006/0202079 | A1 | 9/2006 | Pavlik | |
| 2006/0237579 | A1 | 10/2006 | Doubleday et al. | |
| 2007/0000935 | A1 | 1/2007 | Pavlik et al. | |
| 2007/0044617 | A1 | 3/2007 | Pavlik | |
| 2007/0125214 | A1 | 6/2007 | Dong et al. | |
| 2008/0005882 | A1 | 1/2008 | Kaiser et al. | |
| 2008/0073371 | A1 | 3/2008 | Neiberger et al. | |
| 2008/0142379 | A1 | 6/2008 | Gnatenko | |
| 2009/0188366 | A1 | 7/2009 | Habra et al. | |
| 2010/0032445 | A1 | 2/2010 | Bunoz | |
| 2010/0168685 | A1 | 7/2010 | Drown | |
| 2011/0209594 | A1 | 9/2011 | Withers | |
| 2011/0214544 | A1 | 9/2011 | Vegliante et al. | |
| 2012/0267387 | A1 | 10/2012 | Omdoll et al. | |
| 2014/0096659 | A1 | 4/2014 | Choi | |
| 2015/0203313 | A1 | 7/2015 | Kaiser | |
| 2015/0239615 | A1 | 8/2015 | O'Donnell et al. | |
| 2015/0344256 | A1 | 12/2015 | Kaiser et al. | |
| 2016/0051330 | A1 | 2/2016 | Cosentino, II | |
| 2017/0151687 | A1 | 6/2017 | Vegliante et al. | |
| 2018/0141742 | A1 | 5/2018 | Vegliante | |
| 2018/0141743 | A1 | 5/2018 | Vegliante | |
| 2019/0167047 | A1 | 6/2019 | Vegliante | |
| 2019/0168985 | A1 | 6/2019 | Vegliante | |
| 2020/0011114 | A1 | 1/2020 | Gerstein | |
| 2020/0087099 | A1 | 3/2020 | Vegliante et al. | |
| 2020/0283254 | A1 | 9/2020 | Vegliante et al. | |
| 2021/0214150 | A1 | 7/2021 | Vegliante | |
| 2022/0073263 | A1 | 3/2022 | Vegliante | |
| 2022/0194734 | A1 | 6/2022 | Vegliante et al. | |
| 2023/0056530 | A1 | 2/2023 | Vegliante et al. | |

FOREIGN PATENT DOCUMENTS

| | | |
|---|---|---|
| JP | 1086937 | 4/1998 |
| JP | 200131077 A | 2/2001 |

OTHER PUBLICATIONS

Notice of Allowance dated Mar. 28, 2022, issued in connection with U.S. Appl. No. 17/218,055 (8 pages).

Office Action dated Jun. 1, 2022, issued in connection with U.S. Appl. No. 16/825,783 (14 pages).

Office Action dated Dec. 17, 2021, issued in connection with U.S. Appl. No. 16/689,059 (15 pages).

Plastic Wrap Dipenser Saran Wrap Cutter [online] Published on Oct. 14, 2014 from URL: https://wowbeli.com/plastic-wrap-dispenser-saran-wrap-cutter-poly-bags-cling-film-food-storage-containers-kitchen-accessories-supplies-products/ (8 pages).

Plastic Wrap Dispenser by ChicWrap [online] Retrieved Oct. 16, 2017 from URL: https://www.everythingkitchens.com/chicwrap-plastic-wrap-dispenser-modern-silver-dots-9914.html? utm_source=google&utm_medium=cse&utem_term=9914&gclid=EAlalQobChMl0_O9wZf11glVil6GCh1OXQCdEAQYCCABEgK_zPD-BwE (5 pages).

Office Action dated Oct. 30, 2017, issued in connection with U.S. Appl. No. 29/585,274 (6 pages).

Notice of Allowance dated Dec. 19, 2017, issued in connection with U.S. Appl. No. 29/585,274 (5 pages).

International Search Report of the International Searching Authority dated Jan. 30, 2018, issued in connection with International Application No. PCT/US2017/062770 (3 pages).

Written Opinion of the International Searching Authority dated Jan. 30, 2018, issued in connection with International Application No. PCT/US2017/062770 (8 pages).

Office Action dated Mar. 4, 2019, issued in connection with U.S. Appl. No. 15/832,953 (16 pages).

Written Opinion of the International Searching Authority dated Feb. 26, 2019, issued in connection with International Application No. PCT/US2018/64234 (4 pages).

Search Report of the International Searching Authority dated Feb. 26, 2019, issued in connection with International Application No. PCT/US2018/64234 (3 pages).

International Search Report of the International Searching Authority dated Feb. 27, 2019, issued in connection with International Application No. PCT/US2018/64241 (3 pages).

Written Opinion of the International Searching Authority dated Feb. 27, 2019, issued in connection with International Application No. PCT/US2018/64241 (9 pages).

(56) References Cited

OTHER PUBLICATIONS

Office Action dated May 28, 2019, issued in connection with U.S. Appl. No. 15/832,989 (16 pages).
Office Action dated Jun. 5, 2019, issued in connection with U.S. Appl. No. 15/399,863 (9 pages).
Office Action dated Jun. 5, 2019, issued in connection with U.S. Appl. No. 15/358,816 (7 pages).
Applicant-Initiated Interview Summary dated Jun. 12, 2019, issued in connection with U.S. Appl. No. 15/832,953 (9 pages).
Office Action dated Oct. 24, 2019, issued in connection with U.S. Appl. No. 15/358,816 (8 pages).
Office Action dated Nov. 21, 2019, issued in connection with U.S. Appl. No. 15/832,953 (20 pages).
Notice of Allowance dated Sep. 20, 2019, issued in connection with U.S. Appl. No. 29/656,548 (11 pages).
Applicant-Initiated Interview Summary dated Nov. 12, 2019, issued in connection with U.S. Appl. No. 15/358,816 (2 pages).
Office Action dated Dec. 6, 2019, issued in connection with U.S. Appl. No. 15/832,989 (16 pages).
Office Action dated Dec. 19, 2019, issued in connection with U.S. Appl. No. 15/358,816 (7 pages).
Office Action dated Dec. 20, 2019, issued in connection with U.S. Appl. No. 15/399,863 (9 pages).
Examiner-Initiated Interview Summary dated Dec. 19, 2019, issued in connection with U.S. Appl. No. 15/399,863 (3 pages).
Office Action dated Jul. 10, 2020, issued in connection with U.S. Appl. No. 15/832,989 (17 pages).
Office Action dated Jul. 10, 2020, issued in connection with U.S. Appl. No. 15/358,816 (10 pages).
Notice of Allowance dated Aug. 25, 2020, issued in connection with U.S. Appl. No. 15/399,863 (7 pages).
Examiner-Initiated Interview Summary dated Sep. 25, 2020, issued in connection with U.S. Appl. No. 15/832,953 (1 page).
Notice of Allowance dated Sep. 25, 2020, issued in connection with U.S. Appl. No. 15/832,953 (10 pages).
Office Action dated Jan. 7, 2021, issued in connection with U.S. Appl. No. 15/358,816 (9 pages).
Notice of Allowance dated Dec. 22, 2020, issued in connection with U.S. Appl. No. 15/832,989 (11 pages).
Office Action dated Nov. 12, 2021, issued in connection with U.S. Appl. No. 16/825,783 (12 pages).
Office Action dated Oct. 5, 2022, issued in connection with U.S. Appl. No. 16/689,059 (16 pages).
Applicant-Initiated Interrview Summary dated Jun. 30, 2022, issued in connection with U.S. Appl. No. 16/825,783 (2 pages).
Office Action dated Sep. 20, 2022, issued in connection with U.S. Appl. No. 17/530,876 (6 pages).
Notice of Allowance dated Nov. 21, 2022, issued in connection with U.S. Appl. No. 16/825,783 (7 pages).
Applicant-Initiated Interview Summary dated Dec. 19, 2022, issued in connection with U.S. Appl. No. 15/530,876 (2 pages).
Office Action dated Feb. 17, 2023, issued in connection with U.S. Appl. No. 15/530,876 (8 pages).
Notice of Allowance dated Feb. 27, 2023, issued in connection with U.S. Appl. No. 16/825,783 (7 pages).

* cited by examiner

ROLL-DISPENSED STOCK CONTAINER

CROSS-REFERENCE TO RELATED APPLICATIONS

This application is a continuation of, and claims priority to, U.S. patent application Ser. No. 15/832,953 filed on Dec. 6, 2017, now U.S. Pat. No. 10,894,688 issued on Jan. 19, 2021, the entire disclosures of which are expressly incorporated herein by reference.

FIELD

The present disclosure relates to a roll-dispensed stock container and, in particular, to a roll-dispensed stock container, a cutter assembly, and stock grippers.

BACKGROUND

Various forms of roll-dispensed stock, of different materials, are dispensed from containers in various ways. For example, paper (e.g., wrapping or decorative paper) can be pulled from a continuous roll of the same and cut to length with scissors, a straight-edge blade, a serrated edge, or another cutting device. Roll-dispensed stock, such as gift wrapping, wax paper, parchment, and aluminum foil, can be thin, flexible, and posses a low coefficient of friction, which makes tearing and bunching common problems encountered while trying to cut roll-dispensed stock. Current products that are directed to solving these problem are large, bulky, and costly.

Accordingly, what is needed, but has not yet been developed, are methods and devices for dispending roll-dispensed stock materials that address the problems described above. These and other needs are addressed by the roll-dispensed stock containers of the present disclosure.

SUMMARY

In accordance with some aspects of the present disclosure, a roll-dispensed stock container is provided. The container includes a body having a front wall, a rear wall, a bottom wall, side walls, a support wall, and a lid. The front wall, rear wall, bottom wall, support wall, lid, and side walls could form an enclosure configured and dimensioned to receive a roll of roll-dispensed stock. A cutter assembly could be positioned on the lid. The cutter assembly includes an elongated track and a slidable cutter with a blade. The slidable cutter travels along the track to cut the roll-dispensed stock positioned between the lid and the support wall. In accordance with aspects of the present disclosure, the container can be configured to dispense, and the cutter assembly can be configured to cut, plastic wrap, foil (e.g., aluminum or tin foil), wax paper, parchment paper, tape, duct tape, wrapping paper, and other roll-dispensed stock. One or more fixation strips could be disposed on the support wall and/or on the lid to hold a sheet of roll-dispensed stock in place while the sheet is being cut from the roll. An opening for dispensing the roll-dispensed stock is exposed when the container is in the open configuration and covered when the container is in the closed configuration.

In accordance with some aspects of the present disclosure, a method for dispensing roll-dispensed stock from the container is provided. The method includes dispensing the roll-dispensed stock from the container, drawing the roll-dispensed stock over the one or more fixation strips, closing the lid on top of the roll-dispensed stock, thereby securely holding the roll-dispensed stock in place, and using the cutter assembly to separate a single sheet of roll-dispensed stock. The roll-dispensed stock is securely held in place by the fixation strips and tension is maintained on the roll-dispensed stock to allow the slidable cutter to easily and cleanly cut therethrough.

BRIEF DESCRIPTION OF THE DRAWINGS

To assist those of skill in the art in making and using the disclosed roll-dispensed stock container, reference is made to the accompanying figures, wherein.

DETAILED DESCRIPTION

It should be understood that the relative terminology used herein, such as "front", "rear," "left," "top," "bottom," "vertical," and "horizontal" is solely for the purposes of clarity and designation and is not intended to limit the invention to embodiments having a particular position and/or orientation. Accordingly, such relative terminology should not be construed to limit the scope of the present invention. In addition, it should be understood that the invention is not limited to embodiments having specific dimensions.

Figure 1:
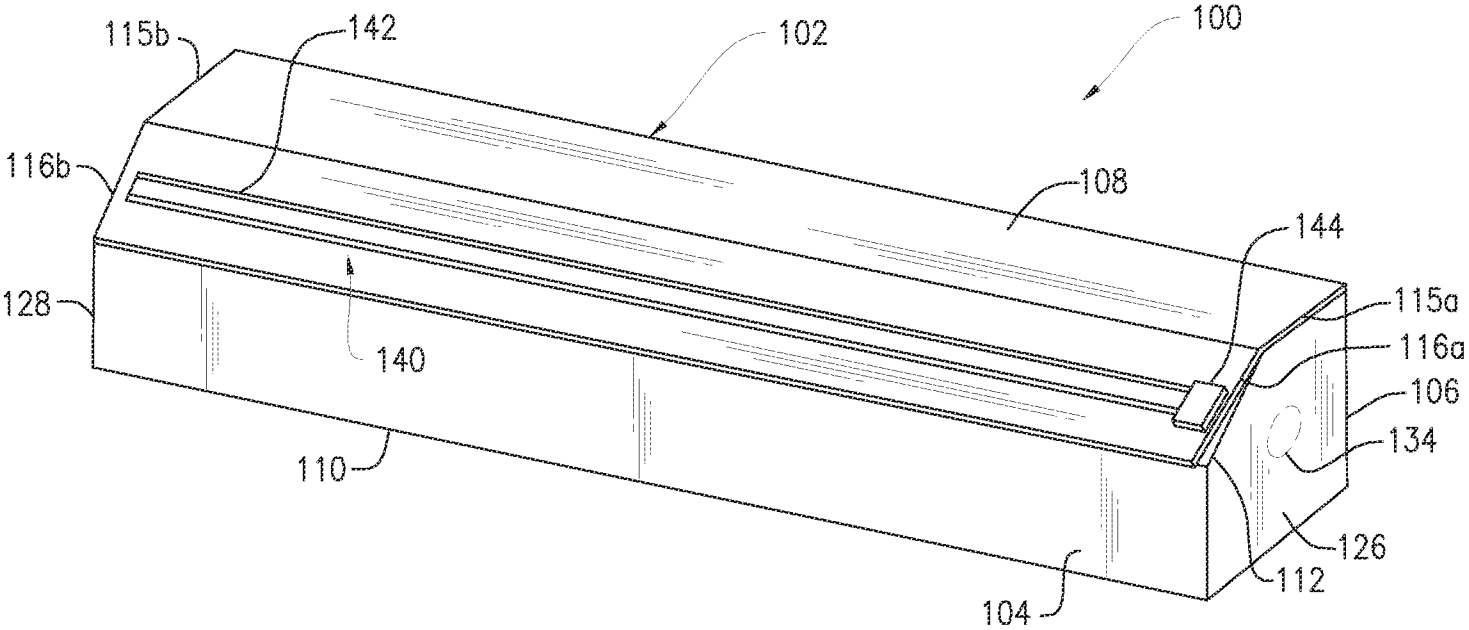
FIG. 1 is a perspective view of a roll-dispensed stock container according to the present disclosure.
Figure 2:
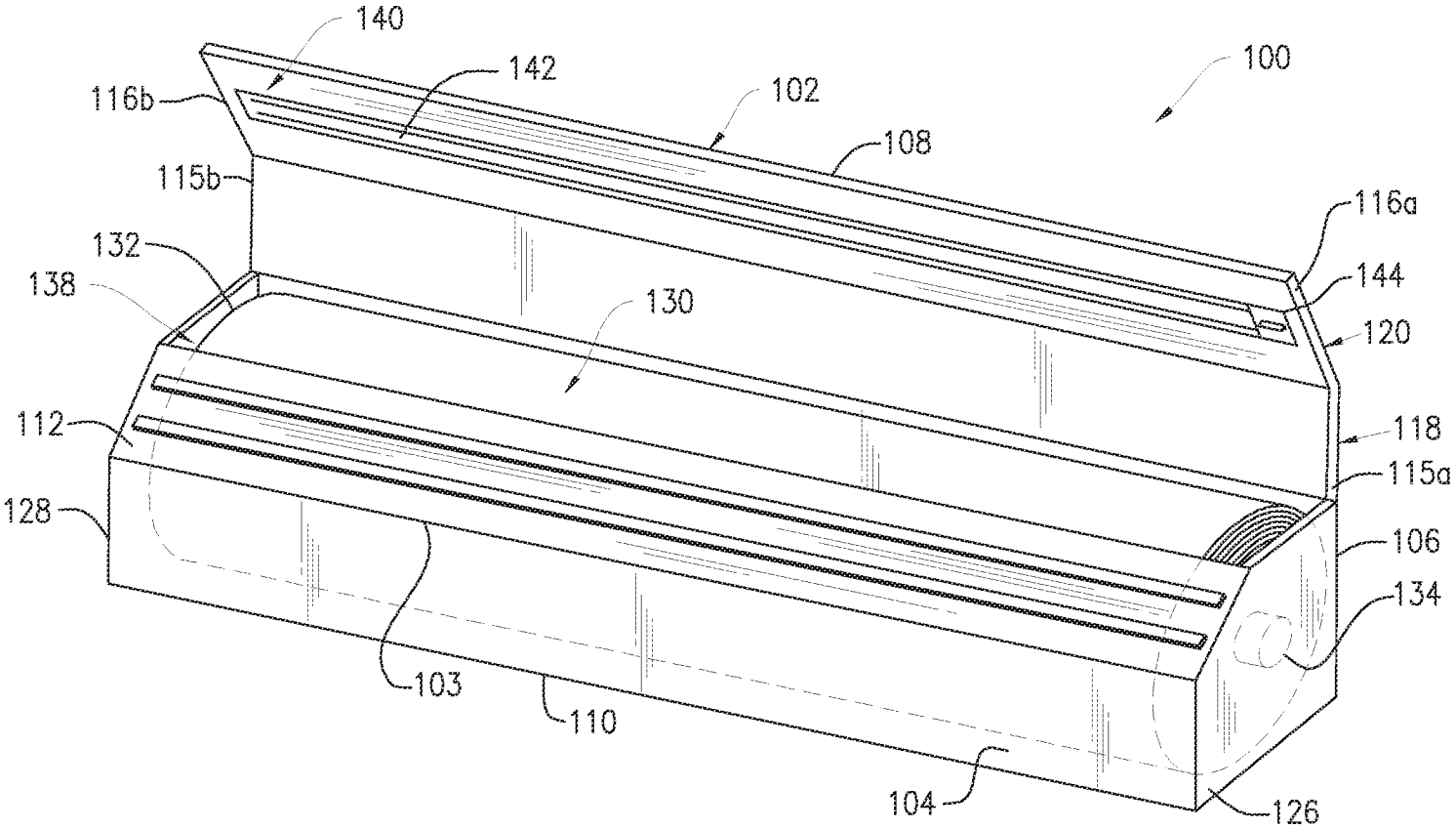
FIG. 2 is a perspective view of the roll-dispensed stock container of FIG. 1 in an open configuration.

FIGS. 1 and 2 show a roll-dispensed stock container (hereinafter "container 100") according to the present disclosure. More specifically, FIG. 1 is a perspective view of the container 100 in a closed configuration and FIG. 2 is a perspective view of the container 100 in an open configuration. The container 100 includes a body 102 including a front wall 104, a rear wall 106, a bottom wall 110, side walls 126,128, a support wall 112, and a lid 108. The body 102 could be formed from a blank (e.g., a continuous piece of material having a substantially planar configuration prior to folding) having multiple perforated lines or fold lines for folding the blank into the configuration of the body 102 of container 100 as shown. The container 100 could be formed from cardboard, plastic, wood, or any other material known to those of ordinary skill in the art that is suitably rigid and durable for receiving and dispensing roll-dispensed stock 132.

The first and second side walls 126, 128 are each connected to edges of the front, rear, and bottom walls 104, 106, and 110 to form a receptacle for holding roll-dispensed stock. The orientation of the first and second side walls 126, 128 and the front, rear, and bottom walls 104, 106, and 110 could be at substantially right angles with respect to adjoining walls. Further, the height of the front wall 104 could be less than the height of the rear wall 106, and the support wall 112 could be joined to a top edge 103 of the front wall 104 and disposed at an angle relative thereto. The support wall 112 could be fixed in position or movable with respect to the top edge 103 of the front wall 104 to allow for roll-dispensed stock 132 to be refilled into the body 102 for re-use.

As shown in FIG. 1, the lid 108 could be hingedly joined to and extend from a top edge of the rear wall 106, over support wall 112, and to the top edge 103 front wall 104. The lid 108 could have a first portion 118 having edges 115*a* and 115*b*, and a second portion 120 having edges 116*a* and 116*b*. The front wall 104, rear wall 106, bottom wall 110, lid 108, support wall 112, and side walls 126, 128 form an enclosure 130 within the body 102 configured and dimensioned to receive a roll of roll-dispensed stock 132 with an opening 138 for dispensing the roll-dispensed stock that is exposed when the container 100 is in the open configuration and obstructed when the container 100 is in the closed configuration.

As shown in FIG. 2, the lid 108 extends over the support wall 112, the underside of the lid 108 extending over the upper side of the support wall 112. The lid 108 could extend entirely or partially over the support wall 112. The first portion 118 and the second portion 120 could be hingedly connected so that the second portion 120 extends to cover the support wall 112 and is positionable so that the second portion 120 is parallel to the plane of the support wall 112. Either or both of the support wall 112 and the lid 108 could have one or more grippers, such as fixation strips 114, for maintaining the position of the roll-dispensed stock 132 prior to cutting. A retainer feature 134 could be in the form of one or more cylinders provided on side walls 126 and 128, or perforated or partially perforated sections configured to be pushed into the enclosure 130, to maintain the position of the roll of roll-dispensed stock 132 within the enclosure 130 of the body 102. The location of the feature 134, if included, defines the approximate axis of rotation for the roll-dispensed stock 132. In another aspect of the present disclosure, the feature 134 can be in the form of an extension mounted to the inner surface of the first and second side walls 126, 128 configured to engage and maintain the position of the roll of roll-dispensed stock 132 within the enclosure 130 (see, e.g., FIG. 2).

The container 100 includes a cutter assembly 140 attached to the body 102. As shown in FIG. 1, the cutter assembly 140 is attached to the lid 108 and includes an elongated track 142 and a slidable cutter 144 with a blade or serrated edge. The slidable cutter 144 could also include an engagement face 164 shaped to receive a finger of a user and pressure therefrom, discussed hereinbelow. The track 142 can be attached to the lid 108 with adhesive or by welding, and the slidable cutter 144 travels along the track 142 to cut the roll-dispensed stock 132 positioned between the lid 108 and support wall 112. The cutter assembly 140 can be provided in any desirable shape. As shown, the cutter assembly 112 extends through the lid 108 and includes a button on the outside of the lid 108, a retainer under the lid 108, and a blade that extends through the lid 108.

In accordance with some aspects of the present disclosure, the container 100 can be configured to dispense, and the cutter assembly 140 can be configured to cut, plastic wrap, foil (e.g., aluminum or tin foil), wax paper, parchment paper, tape, duct tape, wrapping paper, and other materials capable of being delivered as roll-dispensed stock. Further, it is contemplated that any of the containers of the present disclosure (e.g., containers 100, 200, 300, 400, 500, 600, 700, and 800 described herein) could be configured to dispense and cut any of the roll-dispensed stock described herein.

As shown in FIG. 1, the cutter assembly 140 could fit within an area defined by the space under the right angle formed by the intersection of the planes extending from the front wall and the first portion 118 of the lid 108 when the lid 108 is in a closed position, and thus the cutter assembly 140 would not extend beyond the bounds of the container 100 so configured. The cutter assembly 140 is thereby protected from damage during shipping or storage of the container 100. Due to the recessed positioning of the cutter assembly 140, multiple containers 100 can be stacked relative to each other without imparting pressure or force on the cutter assembly 140, thereby preventing potential damage to the cutter assembly 140.

Figure 3:
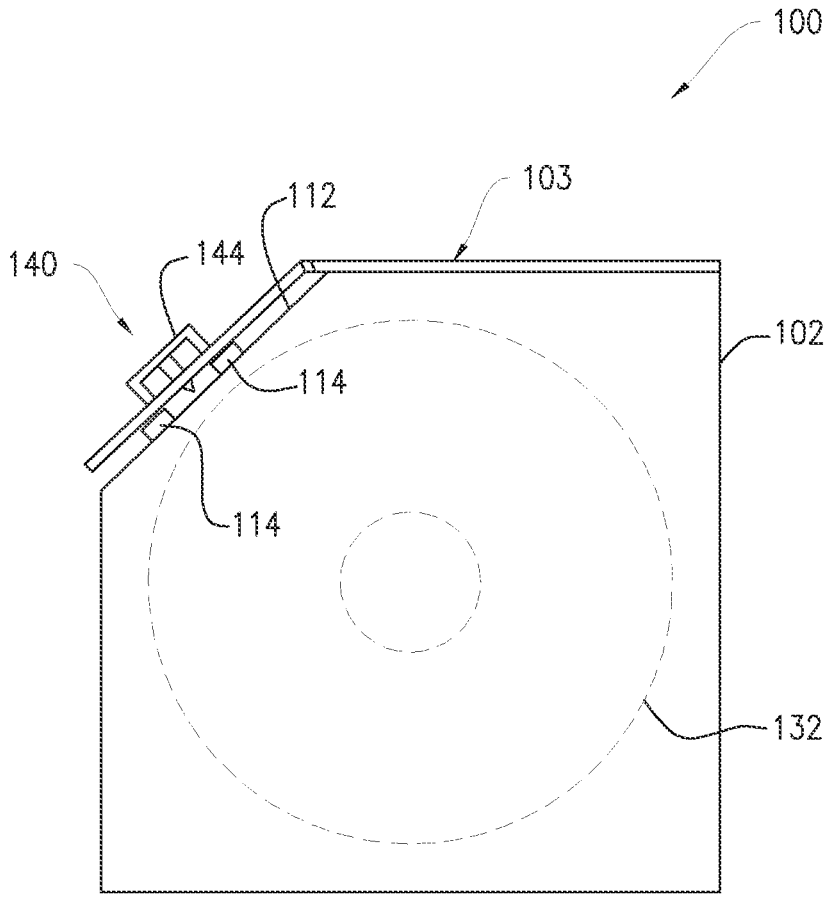
FIG. 3 is a side view of the roll-dispensed stock container of FIG. 1.

FIG. 3 is a side view of the roll-dispensed stock container 100 showing an exemplary arrangement of fixation strips 114 in relation to the cutter assembly 140 and more particularly to the slidable cutter 144. As shown in FIG. 3, one or more fixation strips 114 can be affixed to the support wall 112 of the container 100. When the roll-dispensed stock 132 is dispensed from container 100, described hereinbelow in connection with FIGS. 4-6, the roll-dispensed stock 132 is drawn over the one or more fixation strips 114 (see FIG. 4) and the lid 108 is closed on top of the roll-dispensed stock 132 (see FIG. 5), the fixation strips 114 thereby securely holding the roll-dispensed stock in place while the slidable cutter 144 is used to cut a single sheet of roll-dispensed stock (see FIG. 6). Pressure is applied against the lid 108 and fixation strips 114 when a user presses a finger into the engagement face 164 of the slidable cutter 144 to cut the roll-dispensed stock. The pressure a user applies to the cutter 144 further pushes the lid 108 against the support wall 112 to engage the fixation strips 114 with the adjacent roll-dispensed stock 132. Importantly, because the roll-dispensed stock 132 is securely held in place by the fixation strips 114, tension is maintained on the roll-dispensed stock 132, allowing the slidable cutter to easily and cleanly cut therethrough. For example, as shown in FIGS. 3-6, tension in the roll-dispensed stock 132 material is maintained between the fixation strips 114, regardless of movement on either side of the roll-dispensed stock 132 (e.g., the dispensed end or the roll within container 100). The fixation strips disclosed herein can be positioned so as to not contact, or otherwise interfere with, the cutter assembly 140. Additionally the roll-dispensed stock is not pulled by the cutter. The fixation strips 114 could be made out of any material suitable for securely and removably holding the roll-dispensed stock 132 while it is being cut. Those of ordinary skill in the art will appreciate that the material used for the fixation strips 114 is preferably selected based on the properties of the roll-dispensed stock material. In one example, if the roll-dispensed stock 132 is plastic wrap, foil, wax paper, parchment paper, tape, duct tape, or wrapping paper, the fixation strips 114 could be made of a silicone material, flexible polymer, or another material that provides light tack or clings to the roll-dispensed stock 132. The fixation strips 114 could also be made of a low-tack adhesive (e.g., fugitive, "booger," or "credit card" glue), an ultraviolet (UV) light curing adhesive, a wax, a tacky material, or any other material suitable for securely and removably holding or gripping the roll-dispensed stock 132. In addition to being provided as continuous strips, the fixation strips 114 could be provided as a plurality of discreet segments or beads disposed along a linear path, or could cover an entire surface. According to some aspects of the present disclosure, the fixation strips 114 could be formed from a low-tack adhesive material that is resiliently deformable upon application of force to the cutter assembly 140 and/or lid 108. Pressure applied to the fixation strips 114 during the cutting process causes the fixation strips to deform and tension the roll-dispensed stock therebetween, eliminating bunching and tearing of the roll-dispensed stock, and providing for repeatable and consistent cutting. Further, it is contemplated that any of the containers of the present disclosure (e.g., containers 100, 200, 300, 400, 500, 600, 700, and 800 described herein) could be provided with one or more fixation strips 114 of any material and configuration as described herein.

Figure 4:
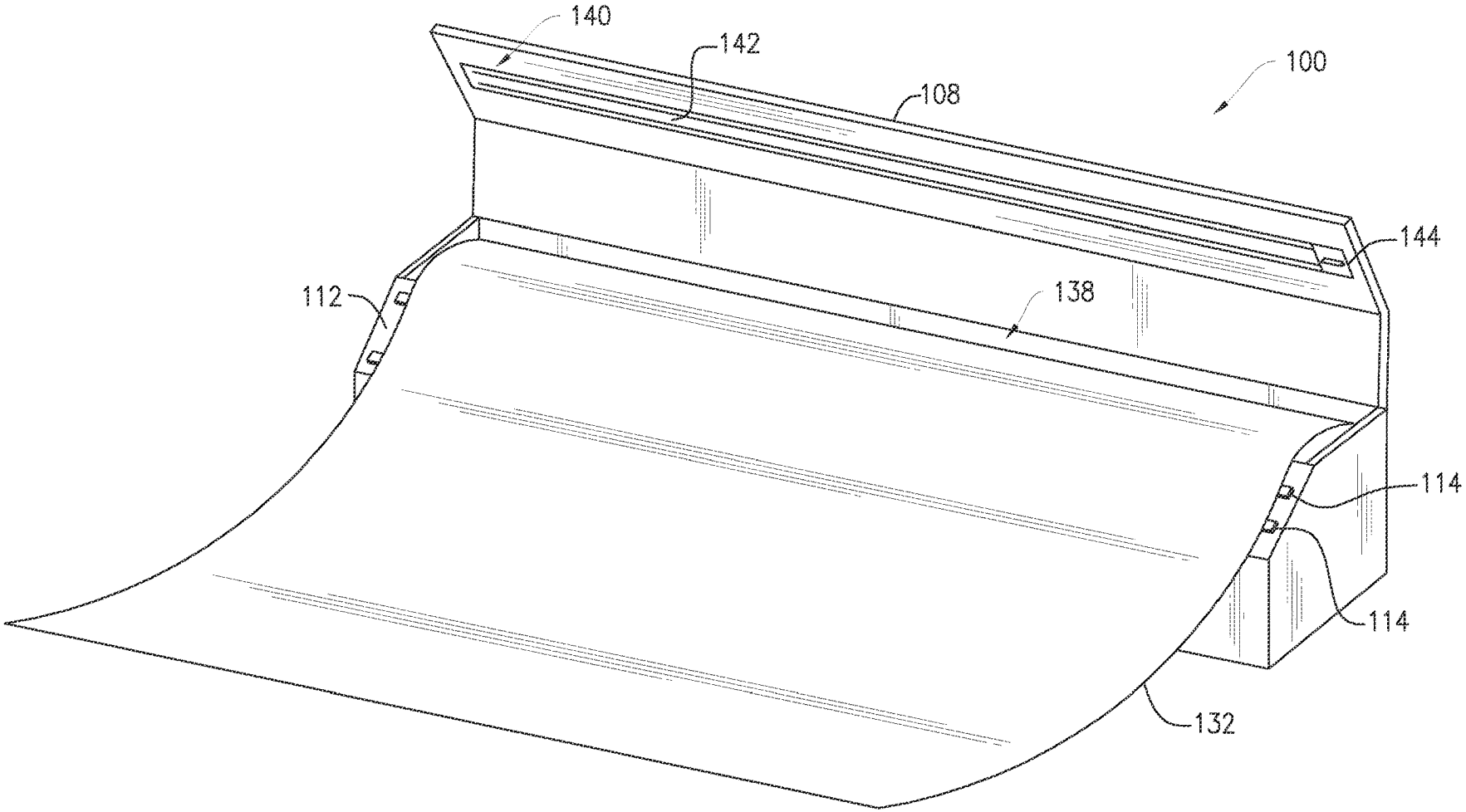
FIG. 4 is a perspective view of the roll-dispensed stock container of FIG. 1 in an open configuration with stock extending from the roll.
Figure 5:
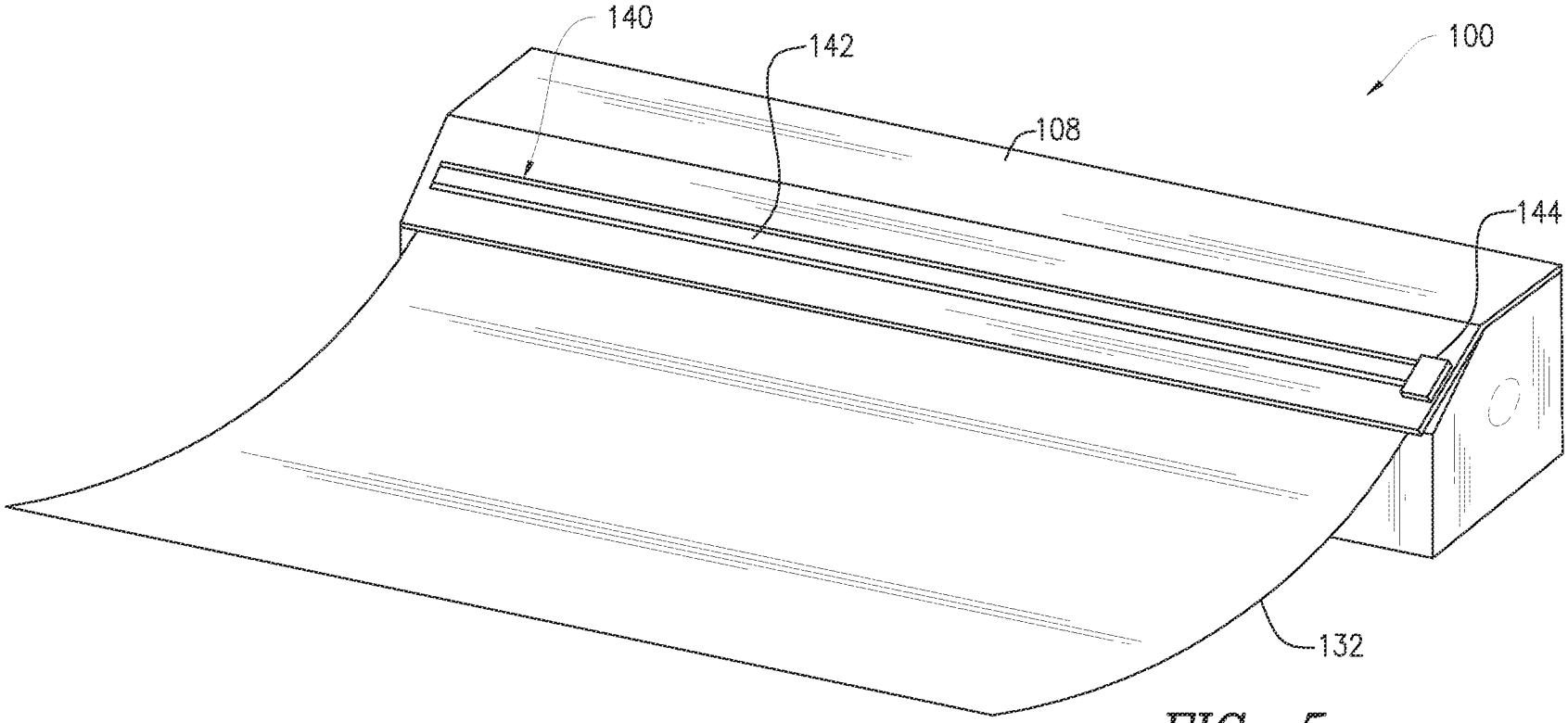
FIG. 5 is a perspective view of the roll-dispensed stock container of FIG. 4 in a closed configuration with stock extending from the roll.
Figure 6:
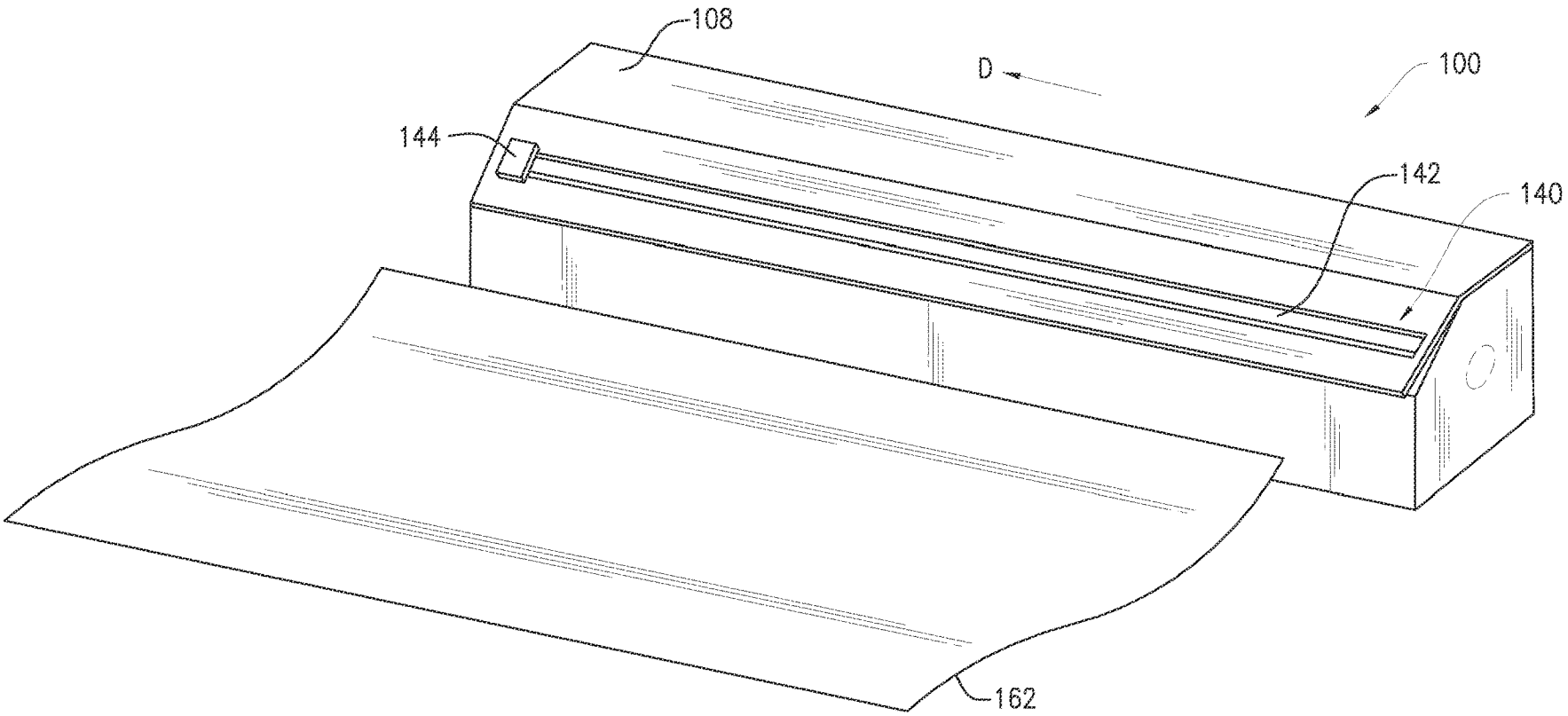
FIG. 6 is a perspective view of the roll-dispensed stock container of FIG. 5 after the cutter has been actuated to cut a section of the roll-dispensed stock.

FIGS. 4-6 show operation of the roll-dispensed stock container 100 according to the present disclosure. More specifically, FIG. 4 is a perspective view of the roll-dispensed stock container of FIG. 1 in an open configuration, thereby allowing for extension of the roll-dispensed stock 132 through the opening 138. FIG. 5 is a perspective view of the roll-dispensed stock container of FIG. 1 in a closed configuration including roll-dispensed stock dispensed from an opening. An end of the roll-dispensed stock 132 can be dispensed through the opening 138 until the desired length of the roll-dispensed stock 132 is achieved. The roll-dispensed stock 132 is positioned against the one or more fixation strips 114 disposed on the support wall 112. The lid 108 can then be closed, thereby positioning the slidable cutter 144 of the cutter assembly 140 adjacent to, or into contact with, the roll-dispensed stock 132. The cutter 144 can then be slid along the track 142 in the direction of arrow D to sever a sheet 162 from the remaining roll-dispensed stock 132. FIG. 6 is a perspective view of the roll-dispensed stock container of FIG. 1 in a closed configuration after the stock was cut by the cutter assembly.

Figure 7A:
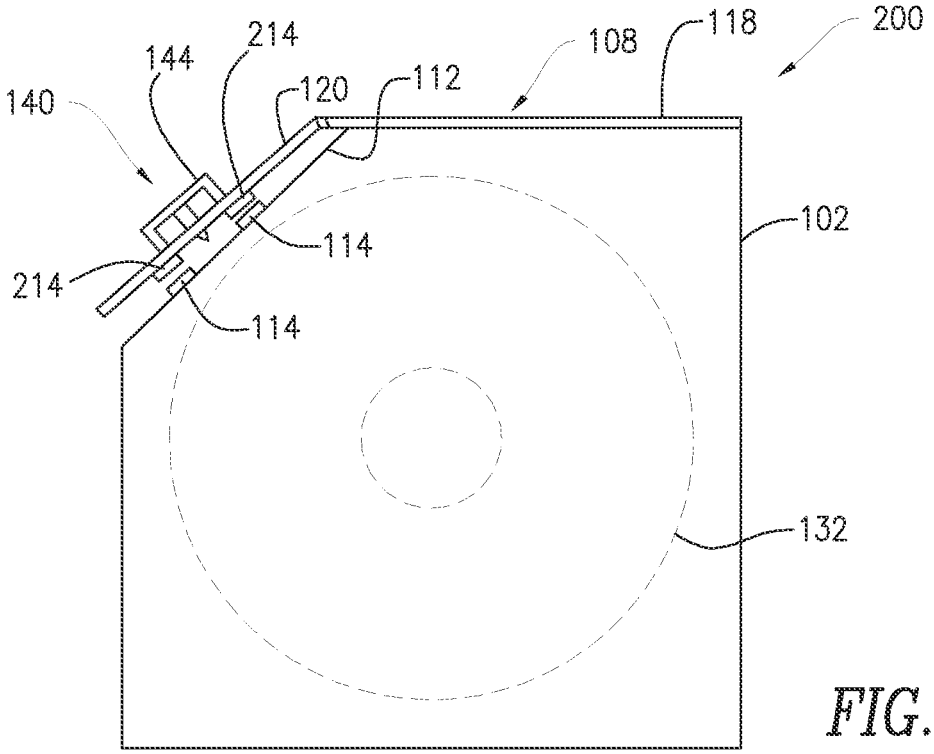
FIG. 7A is a side view of a roll-dispensed stock container according to the present disclosure including fixation strips on both a lid and a support wall of the roll-dispensed stock container.

FIGS. 7A-D are side views of roll-dispensed stock containers according to some aspects of the present disclosure showing additional exemplary configurations of fixation strips. The containers can be substantially similar in structure and function to the container 100, except for the distinctions noted herein. FIG. 7A shows a roll-dispensed stock container 200 including a body 102, a lid 108 having a first portion 118 and a second portion 120, a cutter assembly 140 having a slidable cutter 144, and fixation strips 114 disposed on a support wall 112 on either side of the slidable cutter 144. As shown in FIG. 7A, the container 200 could also include fixation strips 214 disposed on an underside (e.g., the side adjacent to support wall 112 and fixation strips 114) of the second portion of the lid 108 on either side of the slidable cutter 144. Accordingly, container 200 provides fixation strips on either side of the roll-dispensed stock 132 (not shown) as it is being cut in accordance with the steps described in connection with FIGS. 4-6.

Figure 7B:
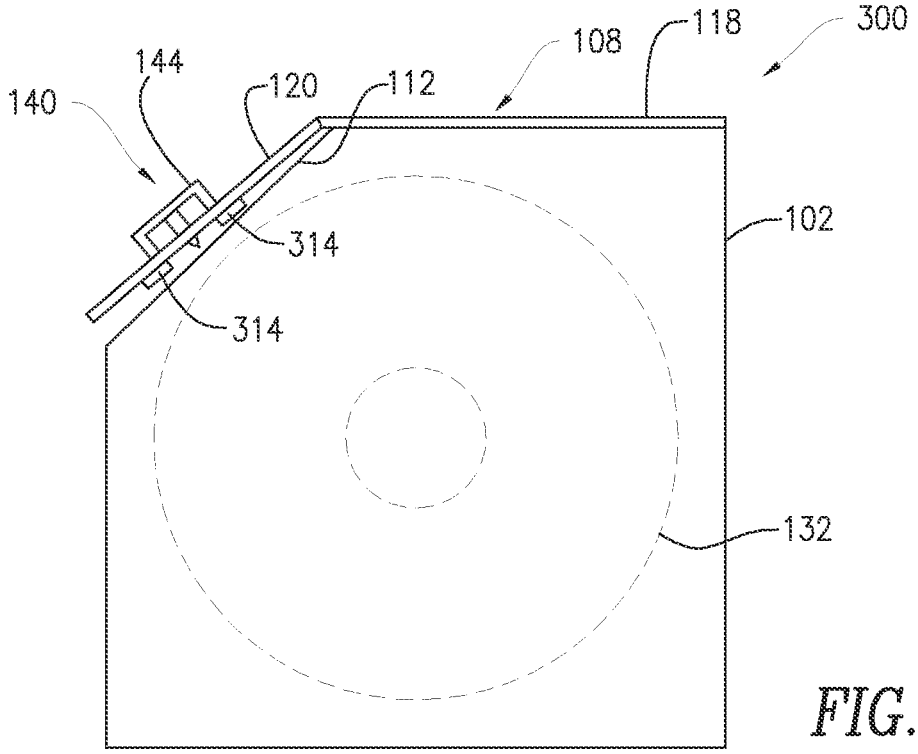
FIG. 7B is a side view of a roll-dispensed stock container according to the present disclosure including fixation strips on only the lid of the roll-dispensed stock container.

FIG. 7B shows a roll-dispensed stock container 300 according to another aspect of the present disclosure and includes a body 102, a lid 108 having a first portion 118 and a second portion 120, a cutter assembly 140 having a slidable cutter 144, and a support wall 112. As shown in FIG. 7B, the container 300 includes fixation strips 314 disposed on an underside (e.g., the side adjacent to support wall 112 and fixation strips 114) of the second portion of the lid 108 on either side of the slidable cutter 144.

Figure 7C:
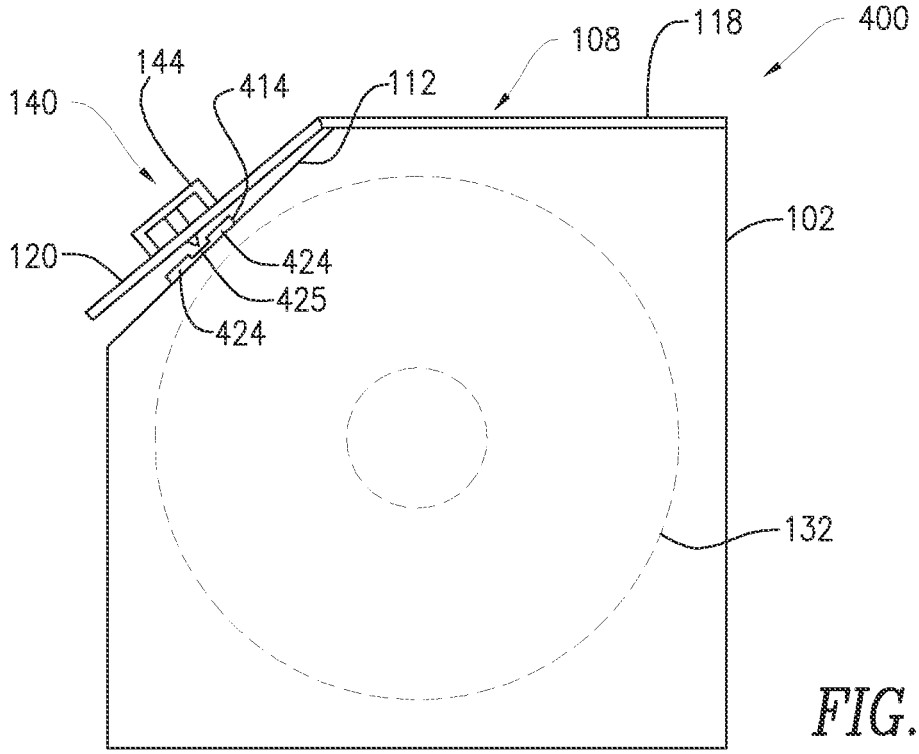
FIG. 7C is a side view of a roll-dispensed stock container according to the present disclosure including a single fixation strip having a recessed center portion positioned on the support wall of the roll-dispensed stock container.

FIG. 7C shows a roll-dispensed stock container 400 according to another aspect of the present disclosure and includes a body 102, a lid 108 having a first portion 118 and a second portion 120, a cutter assembly 140 having a slidable cutter 144, and a support wall 112. As shown in FIG. 7C, in place of one or more fixation strips 114, the container 400 could include a single fixation strip 414 disposed on the support wall 112 having a central recessed portion 425 between two raised portions 424 extending on either side of the slidable cutter 144. Further, the fixation strip 414, and more specifically the raised portions 424, could be configured and dimensioned such that the blade of the slidable cutter 144 passes between the raised ridges 424 when cutting the roll-dispensed stock 132, but does not contact or cut into recessed portion 425 or the support wall 112 thereunder.

Figure 7D:
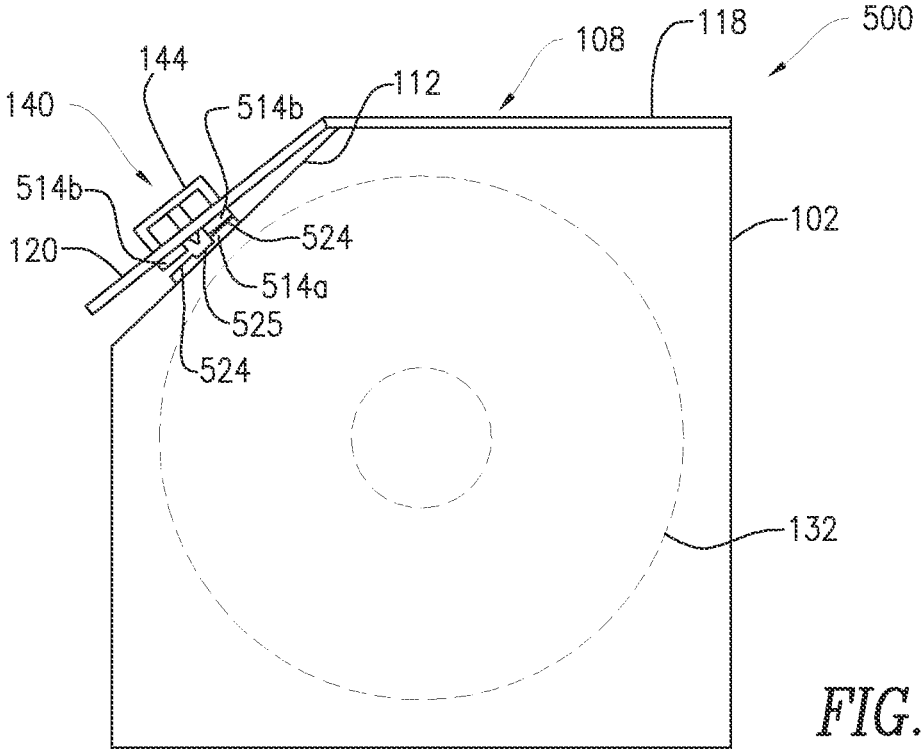
FIG. 7D is a side view of a roll-dispensed stock container according to the present disclosure including fixation strips positioned on the lid of the roll-dispensed stock container and a single fixation strip having a recessed center portion positioned on the support wall of the roll-dispensed stock container.

FIG. 7D shows a roll-dispensed stock container 500 including a body 102, a lid 108 having a first portion 118 and a second portion 120, a cutter assembly 140 having a slidable cutter 144, and a support wall 112. As shown in FIG. 7D, the container 500 could include a single fixation strip 514*a* disposed on the support wall 112 and having a recessed central portion 525 between raised portions 524 extending on either side of the slidable cutter 144. The container 500 could also include one or more fixation strips 514*b* disposed on an underside (e.g., the side adjacent to the support wall 112 aligned with fixation strip 514*a*) of the second portion of the lid 108. Accordingly, container 500 provides fixation strips on either side of the roll-dispensed stock 132 (not shown) to retain and tension the stock as it is being cut.

Figure 8:
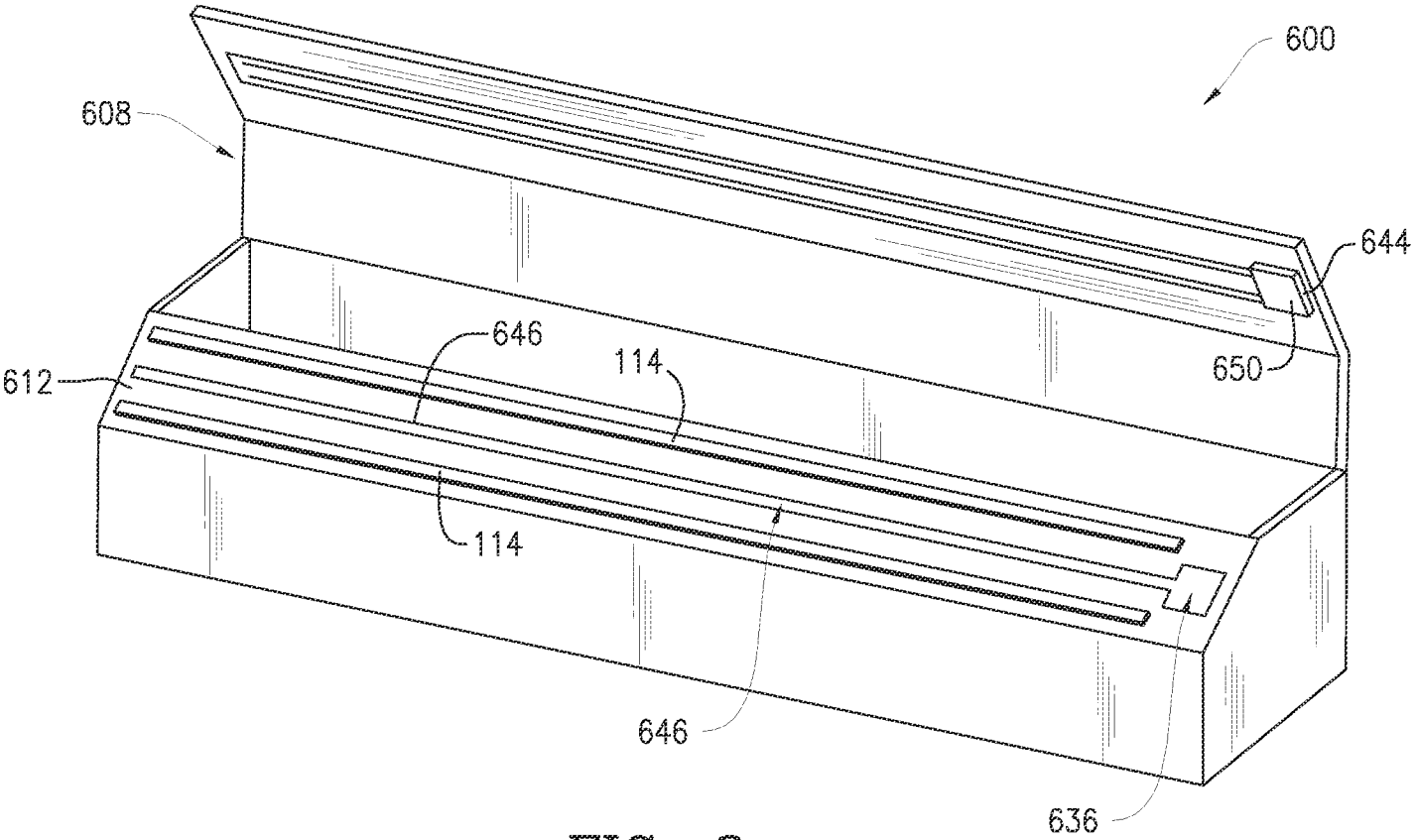
FIG. 8 is a perspective view of another aspect of a roll-dispensed stock container in an open configuration having a slot in the support wall for receiving a lower portion of a slidable cutter.
Figure 9:
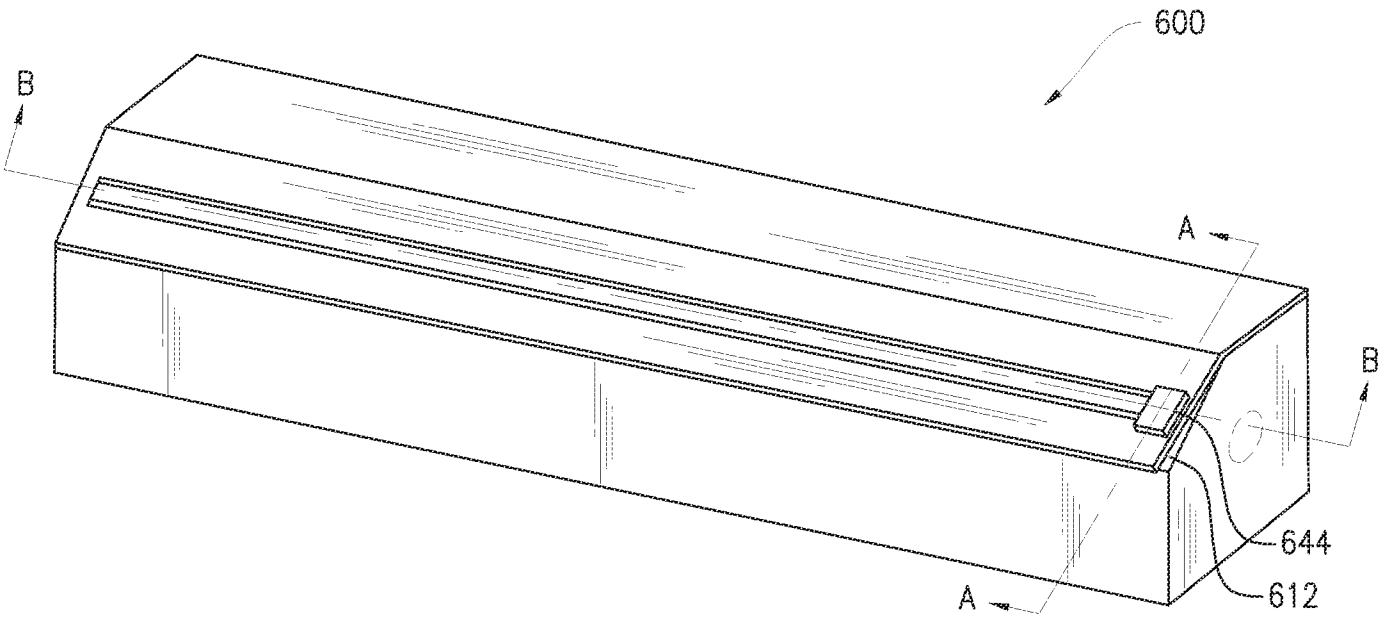
FIG. 9 is a perspective view the roll-dispensed stock container of FIG. 8 in a closed configuration.

FIGS. 8-11B show an exemplary roll-dispensed stock container 600 (hereinafter "container 600") in accordance with some aspects of the present disclosure. Container 600 can be substantially similar in structure and function to the container 100, except for the distinctions noted herein. FIG. 8 is a perspective view of the container 600 in an open configuration and FIG. 9 is a perspective view of the container 600 in a closed configuration. Container 600 includes an aperture 636 for receiving and retaining a base portion 650 of the slidable cutter 644 (see FIGS. 10A-11B), to allow the base portion 650 to move through and extend under a support wall 612. As shown in FIG. 8, the aperture 636 has a slot 646 extending from the aperture 636 and along the support wall 612. This results in an internal blade on the cutter assembly, as the blade is positioned between to the lid 608 and the base portion 650. This configuration also allows for the application of constant and consistent pressure during the cutting process.

Figure 10A:
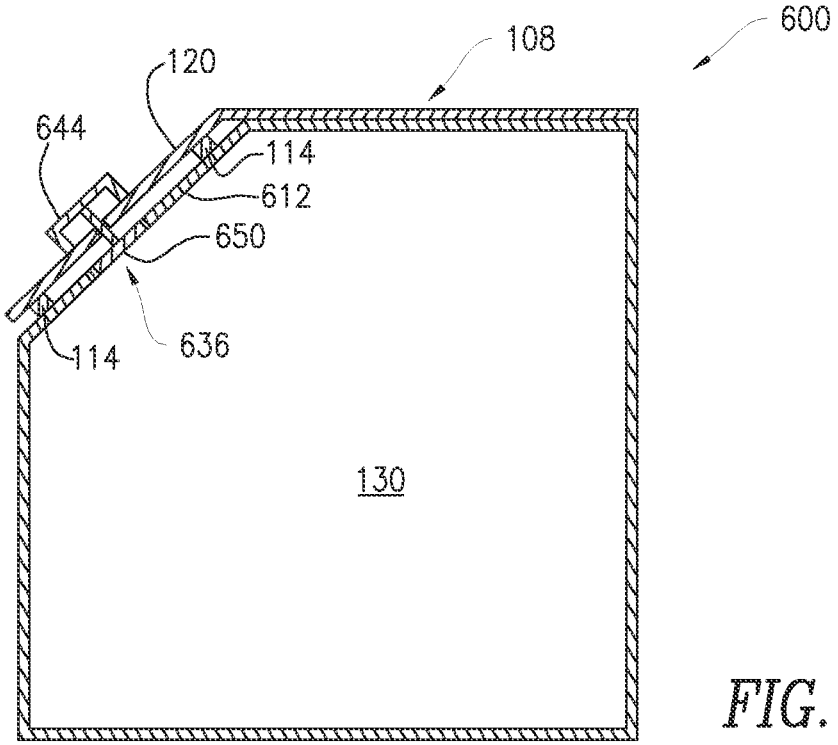
FIG. 10A is a cross-sectional view (taken along line A-A of FIG. 9) of the roll-dispensed stock container of FIG. 9 showing the lid in a first position.
Figure 10B:
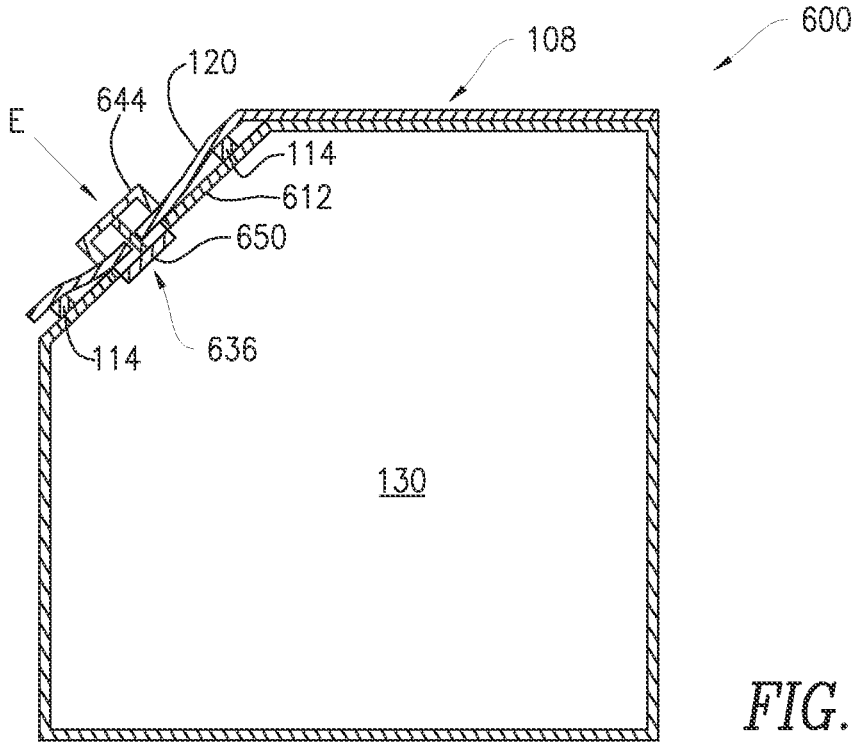
FIG. 10B is a cross-sectional view (taken along line A-A of FIG. 9) of the roll-dispensed stock container of FIG. 9 showing the lid in a second deformed position upon application of force thereto.
Figure 11A:
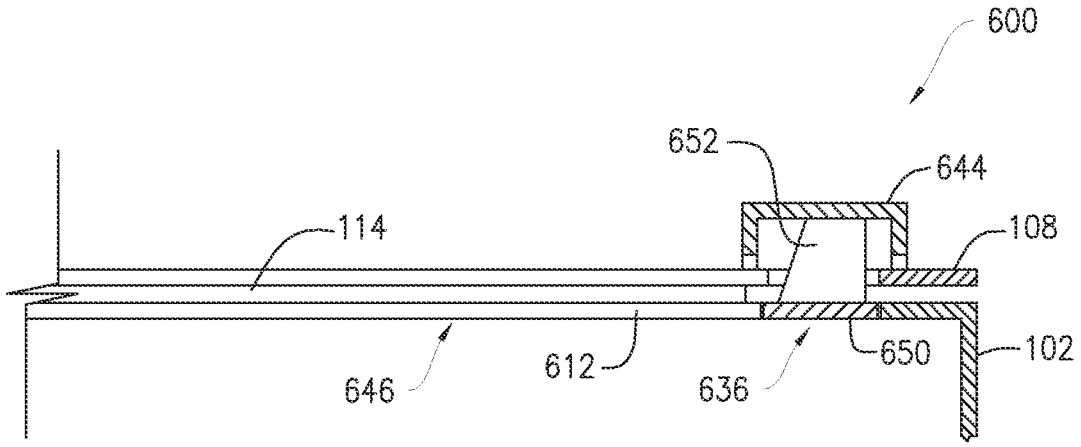
FIG. 11A is a partial cross-sectional view (taken along line B-B of FIG. 9) of the roll-dispensed stock container of FIG. 9 in a first position.
Figure 11B:
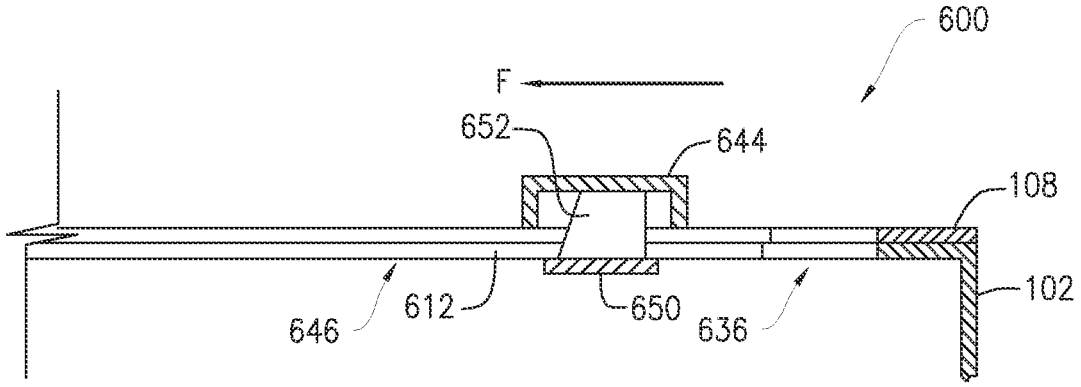
FIG. 11B is a partial cross-sectional view (taken along line B-B of FIG. 9) of the roll-dispensed stock container of FIG. 9 in a second position showing operation of the cutter assembly.

FIGS. 10A and 10B are cross-sectional views (taken along line A-A of FIG. 9) of container 600 and FIGS. 11A and 11B are partial cross-sectional views (taken along line B-B of FIG. 9) of container 600. As shown in FIGS. 10A and 11A, the base 650 of the slidable cutter 644 protrudes below the second portion 120 of the lid 108, but does not fully extend through the aperture 636 (e.g., into enclosure 130) in normal operation (e.g., during storage or transportation). However, as shown in FIG. 10B, upon application of force to engagement face 664 in the direction of arrow E, the second portion 120 of lid 108 is elastically deformed so that the base 650 of the slidable cutter 644 fully extends through the aperture 636. As shown in FIG. 11B, once force has been applied to engagement face 664 in the direction of arrow E and the base 650 of the slidable cutter 644 is fully extended through the aperture 636, the slidable cutter 644 can be moved along elongated track 642 in the direction of arrow F. Notably, the slot 646 extending from aperture 636 can be dimensioned to accommodate a blade 652 of the slidable cutter 644 passing therethrough, but also to retain the base 650 of the slidable cutter 644, thereby preventing the second portion 120 of the lid 108 from returning to its original position. Accordingly, once force is applied in the direction on arrow E and the slidable cutter is moved in the direction of arrow F, pressure is maintained between the one or more fixation strips 114 and the second portion 120 of the lid 108, with the roll-dispensed stock 132 disposed therebetween (not shown). As such, pressing the engagement face 664, and thereby cutter base 650, into the position shown in FIG. 10B maintains the pressure of the roll-dispensed stock against the fixation strips as well as tensioning the roll-dispensed stock. This allows the slidable cutter to more easily and cleanly cut therethrough without a user being required to maintain pressure on the lid 108.

Figure 12:
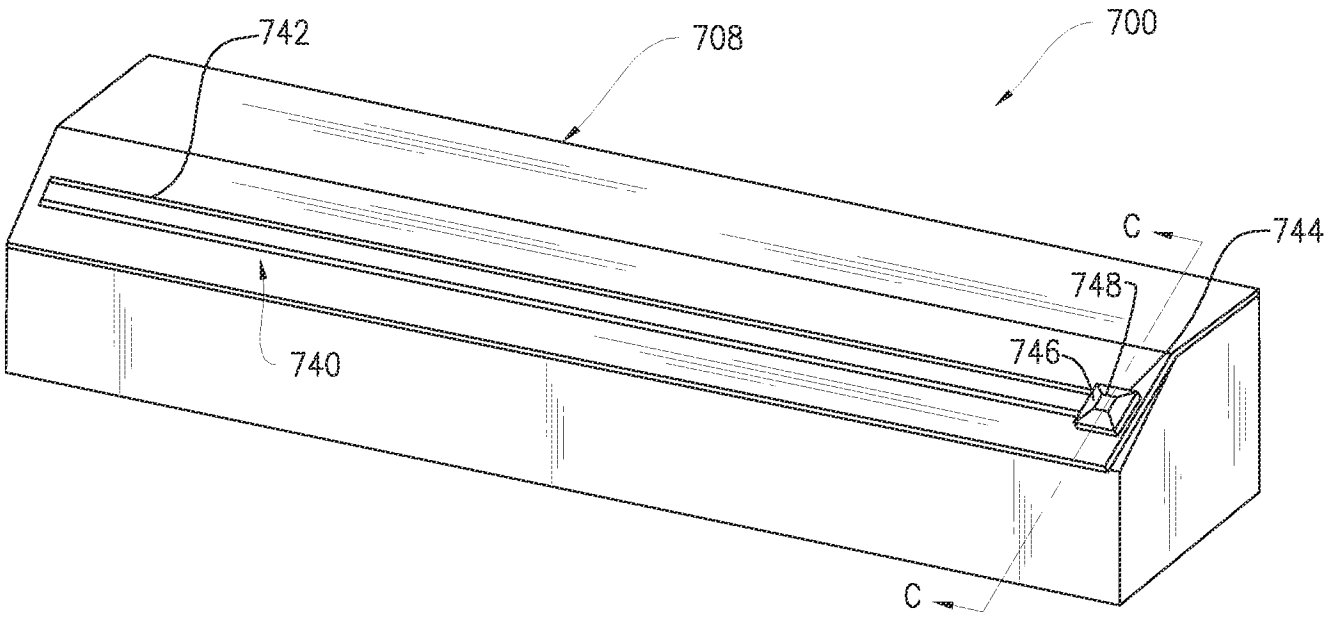
FIG. 12 is a perspective view of another aspect of a roll-dispensed stock container in a closed configuration having a slidable cutter with a recessed blade.
Figure 13A:
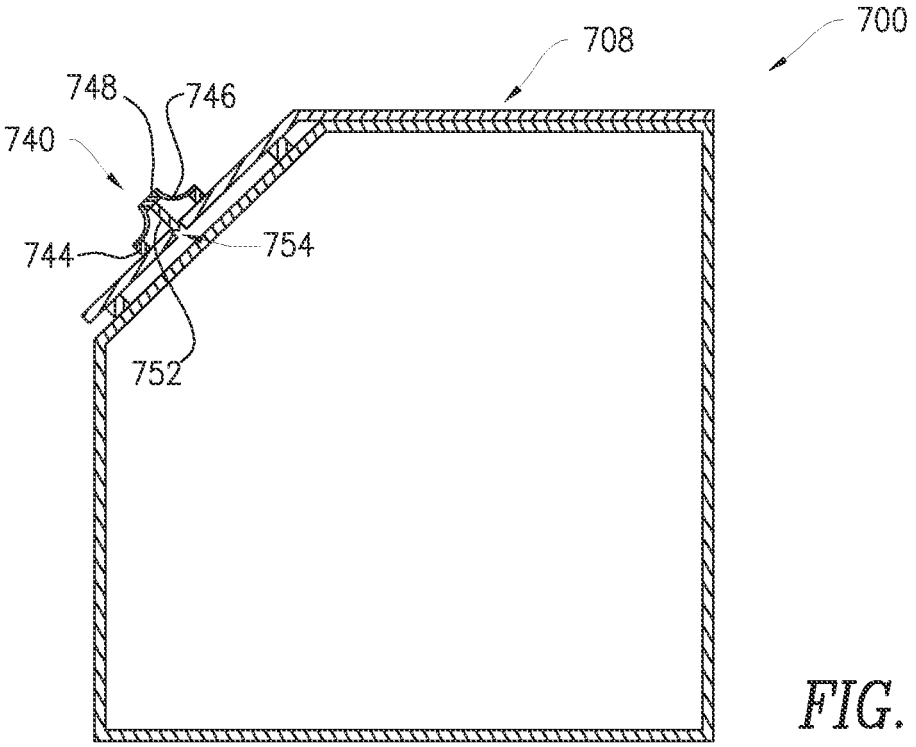
FIG. 13A is a cross-sectional view (taken along line C-C of FIG. 12) of the roll-dispensed stock container of FIG. 12 showing the slidable cutter in a first position.
Figure 13B:
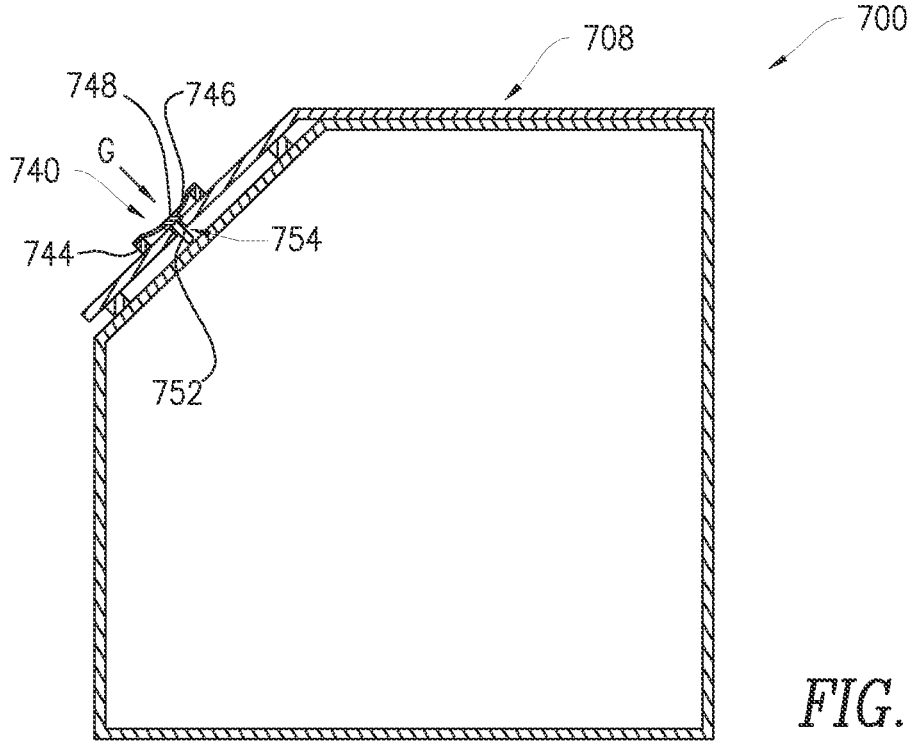
FIG. 13B is a cross-sectional view (taken along line C-C of FIG. 12) of the roll-dispensed stock container of FIG. 12 showing the slidable cutter in a second extended position by application of force thereto.

FIGS. 12-13B show an exemplary roll-dispensed stock container 700 (hereinafter "container 700") in accordance with some aspects of the present disclosure. Container 700 can be substantially similar in structure and function to the container 100, except for the distinctions noted herein. FIG. 12 is a perspective view of the container 700 in a closed configuration. Container 700 could include a lid 708 having a cutter assembly 740 disposed thereon, the cutter assembly 740 having an elongated track 742, a slidable base 744, a resiliently deformable skirt 746, a button 748, and a blade 752. The slidable base 744 can be engaged with the track 742 so as to slide thereon. The resiliently deformable skirt could be coupled to, and provided between, the slidable base 744 and the button 748 and is configured to bias the button 748 in a direction extending away from an exterior side of the lid 708 and slidable base 744. Skirt 746 can be formed from any material, for example, rubber or plastic, that is elastically deformable and capable of providing a bias force between the button 748 and slidable base 744. A blade 752 can be coupled to an underside of the button 748 and can extend into, but not beyond, an elongated slot 754 in the lid 708 (see FIGS. 13A and 13B).

FIGS. 13A and 13B are cross-sectional views (taken along line C-C of FIG. 12) of container 700 showing operation of the cutter assembly 740. As shown in FIG. 13A, the blade 752 of the cutter assembly 740 does not fully extend through the elongated slot 754 of the lid 708 in normal operation (e.g., during storage or transportation). The recessed blade is a safety feature, as it renders the blade unable to contact or cut anything, or anyone, until the container is closed and the cutter is actuated by pressure on the button. As shown in FIG. 13B, upon application of force to button 748 in the direction of arrow G, the skirt 746 is elastically deformed so that the button travels towards the lid 708 and the blade 752 fully extends through the elongated slot 754. Once force has been applied in the direction of arrow G and the blade is fully extended through the elongated slot 754, the slidable base 744 can be moved along elongated track 742, thereby separating a portion of the roll-dispensed stock from the roll. Upon removal of the force from button 748, the button 748 and blade 752 return to their positions as shown in FIG. 13A.

Figure 14:
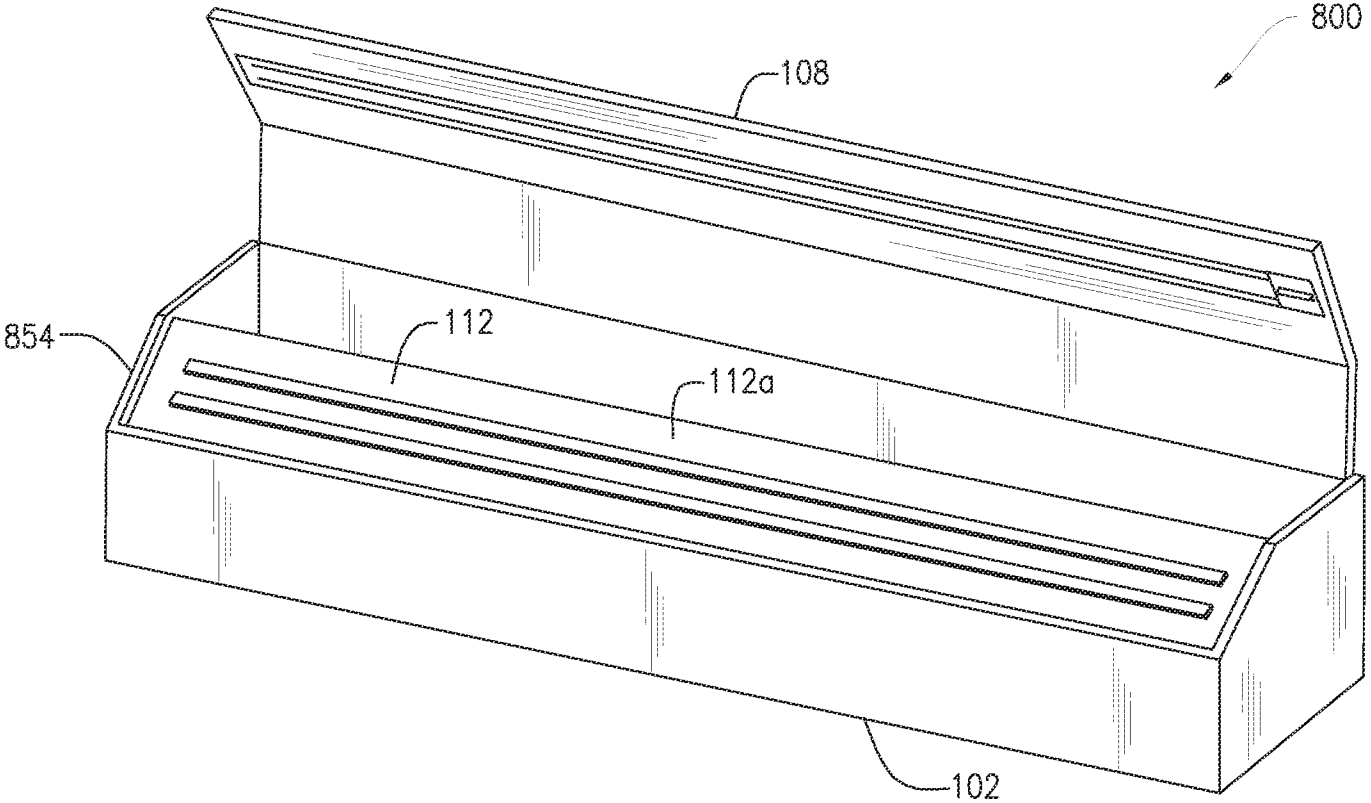
FIG. 14 is a perspective view of a roll-dispensed stock container in an open configuration according to the present disclosure including a snap-fit lid.
Figure 15:
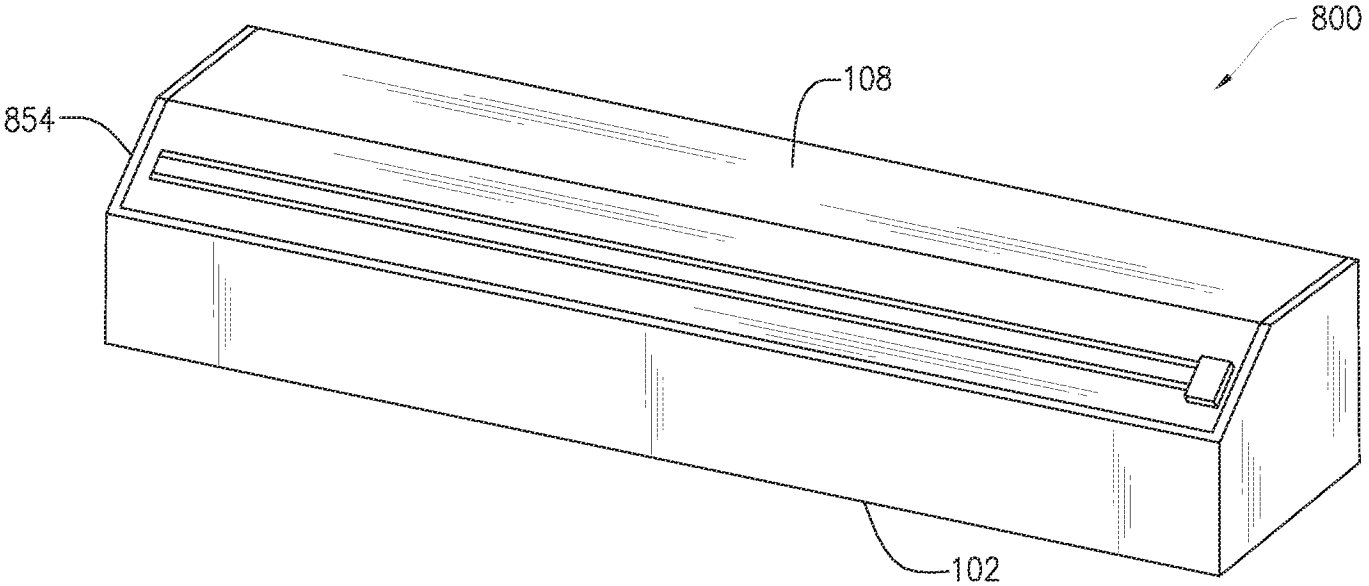
FIG. 15 is a perspective view the roll-dispensed stock container of FIG. 8 in a closed configuration.

FIGS. 14 and 15 show an exemplary roll-dispensed stock container 800 (hereinafter "container 800") in accordance with some aspects of the present disclosure. Container 800 can be substantially similar in structure and function to the container 100, except for the distinctions noted herein. Therefore, like reference numbers represent like structures. FIG. 14 is a perspective view of container 800 in an open configuration according to the present disclosure including a snap-fit lid and FIG. 15 is a perspective view container 800 in a closed configuration. As shown in FIG. 14, the body 102 of container 800 includes a lip 854 protruding therefrom for receiving lid 108 in snap-fit engagement, or the like. As shown in FIG. 15, the lip 854 could completely surround the lid 108. The container 800 could be formed from plastic or any other material known to those of ordinary skill in the art that is suitably rigid and durable for receiving and dispensing roll-dispensed stock and that is capable of being configured with a body and lid being in snap-fit engagement. According to further aspects of the present disclosure, the container of the present disclosure can vary in shape and can include a face that is overlaid by a lid with a cutter. The face can be on the support surface, described hereinabove, or on a vertical front wall, an angled wall, or a horizontal upper wall. The lid can have one or more portions and the cutter overlies the face. The roll-dispensed stock is positioned between the lid and the face and is retained and/or tensioned by one or more fixation strips for cutting.

The present disclosure also contemplates a method for dispensing roll-dispensed stock from a container. The method includes the steps of opening a lid to access an opening in the body of the container, drawing the roll-dispensed stock out of the body through the opening and over a surface of the container, closing the lid against the surface of the container, pressing the lid against the surface of the container to secure the roll-dispensed stock between the lid and the surface by compressing the roll-dispensed stock against one or more fixation strips, sliding the cutter along a length of the lid from a first position to a second position to cut through the roll-dispensed stock, and separating a portion of the roll-dispensed stock from the roll.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

What is claimed is:

1. A roll-dispensed stock container, comprising:

a body including a front wall, a rear wall, a bottom wall, and first and second side walls forming an enclosure to receive a roll of roll-dispensed stock;

a support wall joined to a top edge of the front wall and the first and second side walls, the support wall having a first slot extending therein;

a lid hingedly joined to a top edge of the rear wall having a second slot extending therein, the lid extending over the support wall and covering an opening between the support wall and the rear wall for dispensing the roll-dispensed stock from the enclosure when positioned in a closed configuration; and a slidable cutter movable along the first and second slots and having a top portion, a base portion, and a blade portion disposed therebetween, the top portion of the slidable cutter positioned above the lid, the base portion retained below the support wall, and the blade portion extending through the first and second slots, such that the lid is positioned against the support wall and the roll-dispensed stock is positioned therebetween during cutting;

the slidable cutter positionable at an end of the slots where the lid is in a closed configuration;

wherein the first slot is sized to accommodate the blade portion and to retain the base portion under the support wall as the slidable cutter is moved therealong.

2. The roll-dispensed stock container of claim 1, wherein the rear wall has a greater height than the front wall and the support wall is disposed at an angle thereto.

3. The roll-dispensed stock container of claim 1, wherein the opening is positioned between the top edge of the rear wall and the support wall.

4. The roll-dispensed stock container of claim 1, comprising first and second fixation strips on the support wall, the first and second fixation strips positioned along the path of the cutter when the lid is in the closed configuration.

5. The roll-dispensed stock container of claim 4, wherein the lid is pressed against the first and second fixation strips to deform the first and second fixation strips and tension and secure the roll dispensed stock between the strips where the top portion of the slidable cutter is positioned above the lid, the base portion is retained below the support wall, and the blade portion extends through the first and second slots.

6. The roll-dispensed stock container of claim 5, wherein the slidable cutter has a biased position where the base portion does not extend through the support wall, the slidable cutter movable to an extended portion by application of force against the top portion to extend the bottom portion through the support wall, the bottom portion automatically returning to the biased position when the base portion is not retained by the support wall, and the application of force is removed.

7. The roll-dispensed stock container of claim 6, wherein the lid is elastically deformed by the application of force against the top portion so that the top portion of the slidable cutter is positioned above the lid, the base portion is retained below the support wall, and the blade portion extends through the first and second slots.

8. The roll-dispensed stock container of claim 1, wherein an aperture proximate the first slot is configured to receive the base portion of the slidable cutter.

9. The roll-dispensed stock container of claim 8, wherein the aperture extends through the support wall.

10. The roll-dispensed stock container of claim 1, wherein the lid is held against the support wall and pressure is applied to the roll-dispensed stock positioned between the lid and the support surface during cutting.

11. A roll-dispensed stock container, comprising:

a body including a front wall, a rear wall, a bottom wall, and first and second side walls forming an enclosure to receive a roll of roll-dispensed stock;

a support wall joined to a top edge of the front wall and the first and second side walls, the support wall having a first slot extending therein;

a lid hingedly joined to a top edge of the rear wall having a second slot extending therein, the lid extending over the support wall and covering an opening between the support wall and the rear wall for dispensing the roll-dispensed stock from the enclosure when positioned in a closed configuration;

a slidable cutter movable along the first and second slots and having a top portion, a base portion, and a blade portion disposed therebetween, the top portion of the slidable cutter positioned above the lid, the base portion retained below the support wall, and the blade portion extending through the first and second slots, such that the lid is positioned against the support wall and the roll-dispensed stock is positioned therebetween during cutting; and first and second fixation strips on the support wall, the first and second fixation strips positioned along the path of the cutter when the lid is in a closed configuration, wherein the lid is pressed against the first and second fixation strips to deform the first and second fixation strips and tension and secure the roll dispensed stock between the strips where the top portion of the slidable cutter is positioned above the lid, the base portion is retained below the support wall, and the blade portion extends through the first and second slots;

the slidable cutter positionable at an end of the slots where the lid is in the closed configuration.

12. The roll-dispensed stock container of claim 11, wherein the rear wall has a greater height than the front wall and the support wall is disposed at an angle thereto.

13. The roll-dispensed stock container of claim 11, wherein the opening is positioned between the top edge of the rear wall and the support wall.

14. The roll-dispensed stock container of claim 11, wherein the slidable cutter has a biased position where the base portion does not extend through the support wall, the slidable cutter movable to an extended portion by application of force against the top portion to extend the bottom portion through the support wall, the bottom portion automatically returning to the biased position when the base portion is not retained by the support wall, and the application of force is removed.

15. The roll-dispensed stock container of claim 14, wherein the lid is elastically deformed by the application of force against the top portion so that the top portion of the slidable cutter is positioned above the lid, the base portion is retained below the support wall, and the blade portion extends through the first and second slots.

16. The roll-dispensed stock container of claim 11, wherein an aperture proximate the first slot is configured to receive the base portion of the slidable cutter.

17. The roll-dispensed stock container of claim 16, wherein the aperture extends through the support wall.

18. The roll-dispensed stock container of claim 11, wherein the lid is held against the support wall and pressure is applied to the roll-dispensed stock positioned between the lid and the support surface during cutting.

* * * * *